United States Patent [19]

Andrews et al.

[11] Patent Number: 4,762,200

[45] Date of Patent: Aug. 9, 1988

[54] TREE LADDER

[76] Inventors: Dale D. Andrews, 510 Clark St., Big Rapids, Mich. 49307; Durwood T. Andrews, 8245 Elder Rd., Stanwood, Mich. 49346

[21] Appl. No.: 124,872

[22] Filed: Nov. 24, 1987

[51] Int. Cl.[4] ..... E06C 7/48

[52] U.S. Cl. ..... 182/151; 182/178; 182/189; 182/206

[58] Field of Search ..... 182/100, 189, 150, 206, 182/187, 178, 151; 248/215, 340

[56] References Cited

U.S. PATENT DOCUMENTS

| | | | |
|---|---|---|---|
| D. 185,212 | 5/1959 | Klages | 182/206 |
| 317,534 | 5/1885 | Hoell | 182/189 |
| 1,305,107 | 5/1919 | Hogan | 182/189 |
| 2,052,439 | 8/1936 | Bailey | 182/189 |
| 3,057,431 | 10/1962 | George | 182/163 |
| 3,995,714 | 12/1976 | Brookes | 182/100 |
| 4,002,223 | 1/1977 | Berukrant | 182/206 |
| 4,061,202 | 12/1977 | Campbell | 182/100 |
| 4,257,490 | 3/1981 | Bandy | 182/187 |
| 4,411,335 | 10/1983 | Forrester | 182/187 |
| 4,552,246 | 11/1985 | Thomas | 182/187 |

*Primary Examiner*—Reinaldo P. Machado

*Attorney, Agent, or Firm*—Varnum, Riddering, Schmidt & Howlett

[57] ABSTRACT

A sportman's ladder for allowing convenient climbing of trees and the like includes upper and lower sections assembled together in telescoping relationship. Each section has secured thereto a plurality of spaced-apart steps extending laterally from opposite sides thereof in an alternating manner. The upper section includes a tree limb engaging hook formed as a square, cornered structure having angled gussets at the corners thereof for structural bracing and for improved modes of engagement on the tree limb. The upper section also has a pair of cleats which receive and mount the lower section to the upper section in stacked relationship with respect thereto for convenient carrying of the upper and lower sections when unassembled.

10 Claims, 2 Drawing Sheets

TREE LADDER

TECHNICAL FIELD

This invention relates to collapsible, portable ladders of a type for use by sportsmen in the field for climbing trees and the like.

BACKGROUND ART

It is well known among hunters that the success of the hunt depends, in the broadest context, upon a successful chance encounter of the hunter with the game being hunted. Accordingly, hunters have applied great ingenuity to the task of maximizing the likelihood of such chance encounters.

One approach to hunting which is practiced with a great degree of skill by many hunters is tracking of hunted game. Tracking, however, is not without its difficulties and shortcomings. For example, as tracking necessarily involves movement by the hunter, potentially over a fairly large area, tracking may be rather tiring, especially in rough terrain or severe weather conditions. Additionally, while tracking an animal, a hunter will potentially be within the line of vision and scent range of any animal which he might sight at a near enough distance to get off a safe and sure shot at the game The equipment load which a hunter must carry also adds to the difficulties of game tracking.

An alternative approach to hunting which is especially popular with bow hunters is to sit or "perch" in a tree and quietly await the chance passing of game. Perching offers several advantages over tracking, including elimination or abatement of all the above-mentioned shortcomings.

Despite its advantages, perching has not been without its shortcomings. For example, the tree that is chosen by any given hunter as the most desirable observation point may not be a tree that is well suited to easy climbing. Additionally, the somewhat bulky and heavy hunting clothes as well as the considerable hunting gear which the hunter carries will tend to increase the difficulty of climbing even an otherwise easy-to-climb tree. Accordingly, there have been efforts in the prior art to provide ladder devices for use by hunters to conveniently effect the desired tree climbing without adding undue burdens of additional equipment to the considerable equipment which the hunter must carry in any case.

For example, U.S. Pat. No. 3,057,431, issued Oct. 9, 1962 to George, discloses a combination ladder and seat that may be used by hunters to climb and perch in a tree. The ladder comprises upper and lower sections which are pivotally affixed together, with each section including a pair of spaced-apart, longitudinal stiles or rails and a plurality of steps extending therebetween. A seat is pivotally mounted adjacent the uppermost end of the upper section. The seat is provided with a fastening system to secure the ladder at an elevated location about the vertically-extending tree trunk.

The conventional ladder construction of the George Patent comprising spaced apart longitudinal stiles with steps extending therebetween is also shown in U.S. Pat. No. 4,002,223, issued Jan. 11, 1977, to Bernkrant. Specifically, Bernkrant discloses a ladder with telescopically collapsible side stiles, and hooks adjacent the uppermost end of each stile, whereby the ladder may be secured to a structure by placing the hooks over a generally horizontal structural member such as the railing of a boat. Similar hook portions on a ladder for similar purposes are also disclosed in U.S. Pat. Des. 185,212, issued May 19, 1959, to Klages.

Another type of prior art ladder which is distinguishable from the ladder structures of the above cited patents is a pole type ladder which is characterized by a single longitudinally extending structural member having steps extending laterally to opposite sides thereof. Such pole type ladders are known to be designed as multisection structures suited for easy knockdown or collapse of the ladder into a compact package, and including securing elements which are operative to secure the uppermost end of the ladder with respect to a vertically extending member such as a utility pole or a tree trunk. For example, U.S. Pat. No. 3,995,714, issued Dec. 7, 1976 to Brookes, et al, discloses a multisection, knockdown ladder comprising plural sections of elongated tubular construction with steps extending at spaced locations perpendicularly outward of the tubular sections. A securing structure including an arcuate hook member is mounted adjacent the uppermost end of the Brookes ladder and is operable to encompass a pole or tree trunk to secure the uppermost end of the ladder with respect thereto. U.S. Pat. No. 4,257,490, issued March 24, 1981, to Bandy discloses a collapsible pole type ladder, a platform mounted to the same adjacent an uppermost end thereof, and a securing structure also being mounted adjacent the uppermost end of the ladder to cooperate with the platform in securing the uppermost end of the ladder with respect to a vertically extending member such as a tree trunk.

U.S. Pat. No. 2,052,439, issued Aug. 25, 1936, to Bailey discloses an extensible fireman's ladder comprising, in part, a pair of upper and lower main posts, the upper post being telescopically engageable within the lower. The upper post is provided with pairs of upwardly folding spring biased steps which are pivotally mounted thereto at suitable intervals and which pivot to a collapsed or clear position in response to telescopic collapsing of the upper pole member into the lower. The Bailey Patent also discloses a pair of retention hook members secured at laterally spaced locations with respect to the uppermost end of the ladder, the hook members being laterally pivotal with respect to the ladder.

In spite of the prior efforts in the art at developing portable ladders, there remains a need for a portable, lightweight, reliable, versatile and convenient climbing system for use by hunters to scale trees in the field. Because a hunter's ladder must be hand carried into the field, it must be durable and lightweight, as well as compact and not of unwieldy construction. By the same token however, to serve with intended purpose it must also offer superior structural qualities as well as convenience, safety and reliability in use.

Portable ladders of more complex structure, and especially those with an undue number of movable or adjustable parts, may prove to be unreliable after long term exposure to the elements in the field. Likewise, many known ladders of sufficient structural strength to serve the purpose are also unduly heavy and cumbersome and not well suited to be hand carried into the field by a hunter.

SUMMARY OF THE INVENTION

In accordance with the invention, there is provided a pole-type ladder of knockdown construction having upper and lower longitudinally-extending sections connectable together in substantially end-to-end relationship. A plurality of steps are rigidly secured to and extend laterally from opposite sides of the upper and lower sections. The ladder also includes a connecting means for releasably connecting the upper and lower sections and a mounting means on the upper section and for mounting the ladder to a lateral support. A hook means on the upper section is adapted to engage the lateral support and defines an opening adapted to receive the lateral support when the hook means is engaged with the lateral support. The ladder also has a gusset means for centering the lateral support with respect to the opening so as to limit movement of the ladder with respect to the lateral support when the hook means is engaged with the lateral support and for rigidifying the hook means to resist torsional forces exerted on the hook means when the hook means is engaged with the lateral support and downward and lateral forces are exerted on the steps.

The hook means comprises an upper end of the upper section, a transverse member rigidly secured to or formed integral with and positioned substantially perpendicular to the upper end and a downwardly-depending member rigidly secured to or formed integral with the transverse member and positioned substantially parallel to the upper end of the upper section, with the opening being defined by the upper end and the transverse and downwardly-depending members. The gusset means comprises at least two gussets, with one of the gussets rigidly secured to and between the upper end of the upper section and the transverse member and the other gusset rigidly secured to and between the downwardly-depending member and the transverse member. The gussets define a V-shaped pocket within the opening and adapted to receive the lateral support when the hook means is engaged with the lateral support. In one embodiment of the invention, one gusset is secured to and between adjacent sides of the upper end of the upper section and the transverse member on one side of the ladder, and the other gusset is rigidly secured to and between adjacent sides of the downwardly-depending and transverse members on another side of the ladder.

The ladder also includes a cleat means on the upper section and for mounting the lower section to the upper section in mutually parallel, stacked relationship when the upper and lower sections are not connected together in substantially end-to-end relationship. Specifically, the cleat means comprises a pair of L-shaped brackets secured to the upper section in spaced relationship and which cooperate with the upper section to receive and support the lower section.

With respect to the connecting means, the upper section further comprises a tubular, bottom end and the lower section comprises a tubular top end. The connecting means comprises a sleeve rigidly secured to or formed integral with and positioned in axial alignment with a central, longitudinal axis of the upper section or lower section and in which the lower section or upper section, respectively, is adapted to telescopically engage, a pair of aligned bores extending through opposing walls of the bottom end, a pair of aligned holes extending through opposing side walls of the top end and adapted to align with the aligned bores when the upper and lower sections are telescopically engaged, and a pin pin adapted to removably engage the aligned bores and holes when the upper and lower sections are telescopically engaged to releasably connect the upper and lower sections in substantially end-to-end relationship.

The ladder further includes a handle secured to the upper section and for carrying the upper and lower sections when the lower section is mounted to the upper section by the cleat means.

In an alternative embodiment of the invention, the ladder comprises a central, longitudinally-extending section having and upper end, a plurality of steps projecting substantially transversely from opposite sides of the central section and a mounting means on the upper end and for mounting the ladder to a lateral support. The alternative embodiment of the invention further includes a hook means rigidly secured to or formed integral with the central section, adapted to engage the lateral support, and defining an opening adapted to receive the lateral support when the hook means is engaged with the lateral support; and a gusset means for centering the lateral support with respect to the opening to limit movement of the ladder with respect to the lateral support and for rigidifying the hook means to resist torsional forces exerted on the hook means when the hook means is engaged with the lateral support and downward and lateral forces are exerted on the steps.

BRIEF DESCRIPTION OF THE DRAWINGS

The invention is described hereinbelow with reference to the accompanying drawings, in which.

DESCRIPTION OF THE PREFERRED EMBODIMENTS

Figure 1:
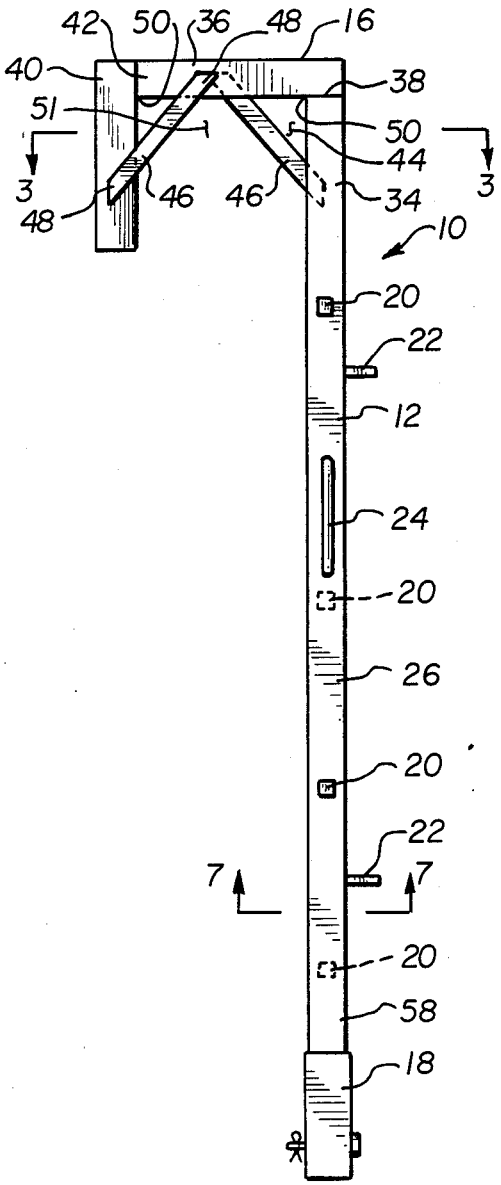
FIG. 1 is a side elevational view of an upper section of a ladder according to the invention.
Figure 2:
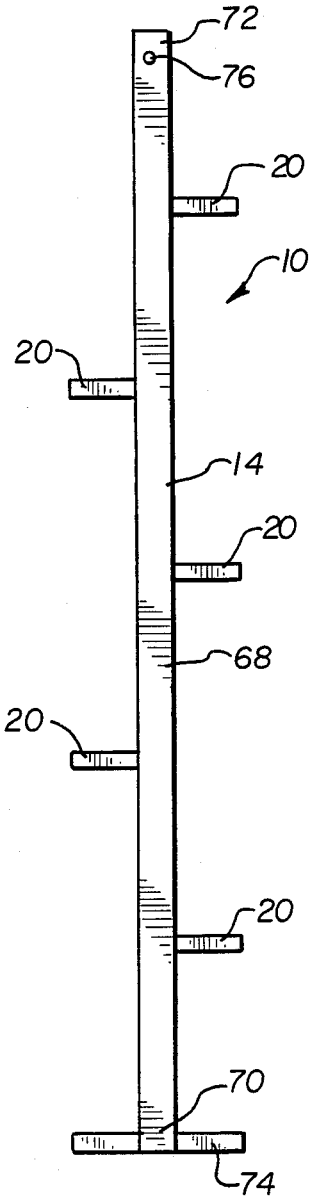
FIG. 2 is a frontal elevational view of a lower section of the ladder.

As shown in FIGS. 1 and 2, a portable, knockdown, pole-type ladder 10 comprises an upper section 12 and a lower section 14. Although, additional intervening sections may be included between the upper and lower sections 12, 14, for purposes of this description, only the upper and lower sections are described.

The upper section 12 is a unitary structure of suitable metal stock, for example one-inch square aluminum alloy tubing such as 6061-T6 aluminum alloy. The upper section 12 includes a downwardly-opening branch engaging hook 16 adjacent its upper end 34, and a connection assembly 18 adjacent its lower end 58 for connection thereof a connection portion 72 of the lower section 14. Upper section 12 further comprises a plurality of longitudinally spaced steps 20, a pair of angular cleats 22 and a carrying handle 24, all of which are rigidly secured to an elongated, generally square, tubular aluminum alloy structural member designated as main body portion 26 of upper section 12 and extending intermediate connection assembly 18 and hook 16.

Figure 5:
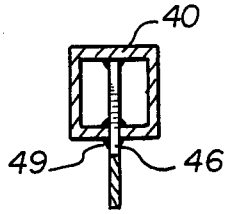
FIG. 5 is a sectional view of a third embodiment of the hook taken on a line similar to that taken with respect to FIGS. 3 and 4.
Figure 6:
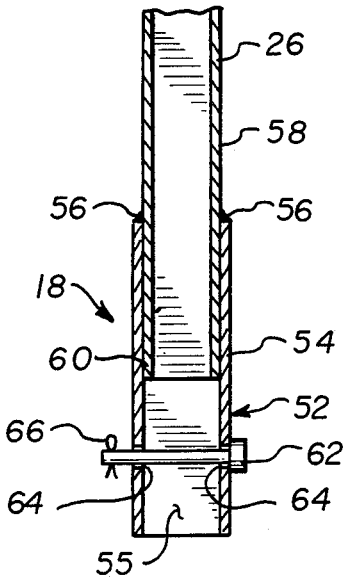
FIG. 6 is a sectional view of the upper section of FIG. 1.

As shown in FIG. 5, the cleats 22 are rigidly secured to main body portion 26 at longitudinally spaced locations as by weldments 28. Each cleat 22 is an L-shaped member, includes a base 30 which projects laterally outward of the member 26, and a retention arm 32 which projects generally perpendicular to base 30 and in conjunction therewith and with an adjacent sidewall 33 of main body portion 26 forms a pocket to receive the lower section 14. The cleats 22 are spaced longitudinally of main body portion 26 to provide suitable support of the lower section 14 with respect to the upper section 12 in stacked relationship.

As shown in FIG. 1, the handle 24 extends generally longitudinally of main body portion 26 and is rigidly affixed thereto as by welding at a location generally coincident with the point of balance for the upper section 12 with the lower section 14 being carried in the cleats 22 as above described.

The steps 20 are of the same structural material as the other elements of ladder 10 but may be of smaller dimension stock, for example a smaller cross-section square tube stock. Each step 20 is rigidly secured to one or the other of opposite lateral sides of main body portion 26, as by welding, so as to project laterally therefrom in a cantilever fashion. Steps 20 thus extend generally within a common plane that is coincident with the longitudinal axis of main body portion 26. Preferably, steps 20 project alternately from opposite sides of main body portion 26, as shown in FIGS. 1 and 2, to provide respective left and right steps. This arrangement of the steps 20 provides improved convenience in manipulating the upper section 12 among branches and other obstacles thereby greatly facilitating carrying of the ladder into the field, and of hoisting the ladder up into a tree as would be done by a user who wishes to reach a higher location in the tree. The use of the alternating left and right step pattern also saves on structural material, and therefore on the total weight of the ladder apparatus.

Figure 3:
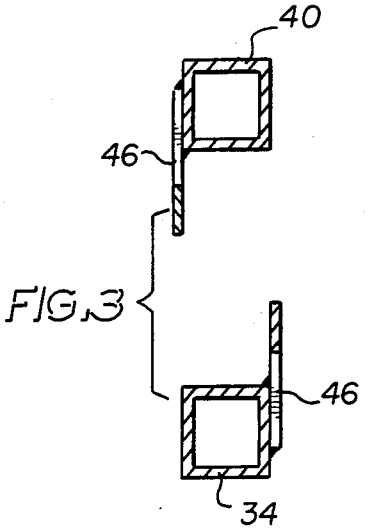
FIG. 3 is a sectional view of a hook of the ladder taken on line 3-3 of FIG. 1.

As illustrated in FIGS. 1 and 3, the hook 16 comprises the upper end 34 of the main body portion 26, a transverse member 36 affixed as by welding to the uppermost end 34 of main body portion 26 and extending transversely therefrom in a direction generally perpendicular to the plane of steps 20, and a return member 40 which projects downwardly from the outer end 42 of the transverse member 36. These elements form a downwardly opening pocket 44 which is adapted to overlie and contain a tree limb to secure the ladder 10 with respect to the tree being climbed.

Figure 4:
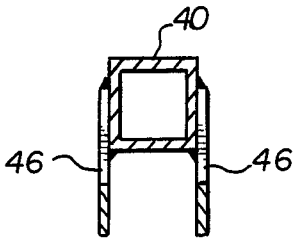
FIG. 4 is a sectional view of a second embodiment of the hook taken on a line similar to that taken with respect to FIG. 3.

The hook 16 is reinforced by gussets 46 formed as elongated plate-like members, the longitudinal ends 48 of which are rigidly secured to members 34, 36, 40. In a preferred embodiment of the ladder 10, as shown in FIGS. 1 and 3, one gusset 46 is rigidly secured to members 34, 36 on one side of the hook 16, and another gusset is secured to members 36, 40 on the other side of the hook. In an alternative embodiment, as shown in FIG. 4, 4 gussets are employed, with one pair of gussets secured to and between members 34, 36 on opposite sides of the hook, and another pair of gussets secured to and between members 36, 40 on opposite sides of the hook. This arrangement provides additional reinforcement to hook 16. In a third embodiment, as shown in FIG. 5, a pair of gussets 46 are rigidly secured to and extend through slots 49 within adjacent side walls of members 34, 36, 40. Other alternative structures for the gussets 46 are also contemplated, including but not limited to gusset plates generally of a triangular shape (not shown) which reside within and are welded to interior corners 50 of hook portion 16, and square or similarly configured tubing sections cut to occupy the corners 50, or to extend across the corners 50.

In all of the above described embodiments, the hook 16 includes gussets 46 secured and positioned at angles to members 34, 36, 40 so as to form a V-shaped opening 51 which receives a branch in more or less centered orientation within the pocket 44. The V-shaped opening 51 allows the weight of the ladder 10 and climber to enhance engagement of the ladder on the branch that is engaged thereby so that all modes of potential movement of the hook 16 with respect to the tree are minimized. For example, for and aft freeplay of hook 16 with respect to the branch engaged thereby is eliminated, as is substantially all lateral or side-to-side wobble, as will be discussed hereinbelow.

An alternative to welded construction of the hook 16 would entail bending of the upper end 34 of the main body portion 26 into the desired hook form and welding the gussets 46 thereto. Still another alternative which combines bending and welding would entail cutting of deep V-shaped notches (not shown) at suitable locations in main body portion 26 to permit bending thereof into a hook formed with the V-shaped notches located at the corners 50 and the sides of the notches coming together after bending to be then welded together to form a unitary structure.

For further reinforcement of the hook portion 16, transverse member 36 may have a metal insert (not shown) such as a $\frac{3}{4}$ inch square bar of identical aluminum alloy telescopically placed therein.

Figure 7:
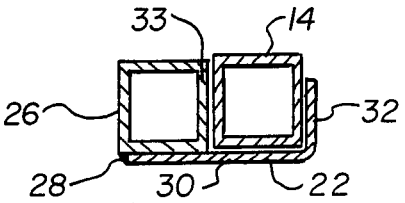
FIG. 7 is a sectional view taken on line 5—5 of FIG. 1.

Referring to FIG. 7, the connection assembly 18 comprises an enlarged portion 52 of upper section 12, which may be, for example, a square section aluminum alloy sleeve 54 which is fixedly secured as by welding at 56 to a lower end 58 of main body portion 26 to form an open-ended pocket 55 outwardly adjacent a terminal end 60 of main body portion 26. The terminal end 60 of main body portion 26 projects into sleeve 54 and is closely engaged therein to provide suitable strength for the assembly 18. Due to the square cross-section of the sleeve 54 and the main body portion 26, a 4-corner interlocking engagement therebetween is realized which provides ample support for transmission of torque loads therebetween without danger of unduly stressing welds 56. A clevis pin 62 extends within a pair of aligned bores 64 formed within sleeve 54 longitudinally outward of terminal end portion 60 and a hitch pin 66 is provided to captively retain clevis pin 62 in registry with the aligned bores 64.

As shown in FIG. 2, the lower section 14 of ladder 10 is preferably constructed of the same aluminum alloy as used for upper section 12 and comprises an elongated main body member 68 which extends intermediate a base portion 70 and the connection portion 72. A plurality of steps 20 are rigidly secured to main body member 68 at spaced locations in precisely the same manner as that described above with regard to the steps 20 of the upper section 12. It is noted, however, that the length of main body member 68 is selected, with regard to the suitable spacing of steps 20, such that the distance between the uppermost step 20 of upper section 14 and the lowermost step 20 of upper section 12 will be of sufficient distance to facilitate convenient use when the ladder sections 12, 14 are assembled. A base 74 is rigidly secured to the base portion 70 of the main body member 68. The base 74 serves to support the ladder 10 with respect to the ground and may be supplemented by tying thereof to a stake (not shown) driven into the ground or to the base of the tree (not shown). Alternatively, a suitable eyelet (not shown) may be provided adjacent the base 74 for such tying off and securing.

Adjacent the connection portion 72 of main body member 68 a through bore 76 is provided. The through bore 76 is positioned for registry with bores 64 when the upper and lower to sections are positioned in telescoping engagement as described below.

To assemble the ladder 10, the connection portion 72 of the main body member 68 is inserted into pocket 55 and then clevis pin 62 is inserted through the aligned bores 64, 76. The hitch pin 66 is then installed to provide positive retention of the two sections 12, 14 with respect to each other. As above noted with regard to retention of upper body portion 26 with respect to sleeve 54, the mating corners of the square cross-sections of connection portion 72 and pocket 55 carry substantially all torque loads to thereby relieve clevis pin 62 of shear loads and eliminate any danger of clevis pin shearoff in use.

An alternative structure for connection assembly 18, for use in lieu of the sleeve 54, would entail enlargement or expansion of the lower end 58 of main body portion 26 to provide an enlarged section portion (not shown) thereof having interior cavity dimensions suitable to slidably receive the connection portion 72 of lower section 14 therein.

It will be appreciated that torque loads on a pole type ladder are a primary concern to the user. With a conventional stile-type ladder, the side rails of the ladder provide laterally spaced apart support points at the base, and the point at which the upper end of the ladder rests against a supporting structure, or a suitable clamping mechanism such as shown in the prior art patents, provides upper end support. Both of these modes of support are well adapted to carry any twisting or torque loads imparted to the ladder by.the climbing action of the user. In the case of a pole type ladder, however, the support structure generally is concentrated along the central axis of the main longitudinal structural member of the ladder, and the climbing action of the user therefore imparts significant torquing or twisting load inputs to the ladder structure as the support of the climber's feet generally may be outboard of the ladder support. For this reason, pole type ladders, unless provided with sophisticated retention and support structures, may be subject to lateral wobble alternately to the left and right as the climber proceeds up the ladder, imparting by his alternate steps alternate left and right torque or twisting loads. Of course, as has been noted hereinabove, the prior art does contemplate various modes of support for pole type ladders; however, such structures generally have been complex and therefore expense, have involved moving or adjustable parts, and have been of considerably more weight than is desirable for a portable ladder intended for field use.

According to my invention, a sturdy and stable pole type ladder is provided for use in climbing trees and other irregular structure even though only a single retention hook structure, as described, is provided for the ladder. Prior ladders have employed multiple laterally spaced hooks, multiple movable hooks, and a varied unduly complex and expensive expedients which were often suitable at best only for securing a ladder with respect to very regular and uniform structures such as those structures presenting a substantially uniform horizontal structural portion to which the ladder retention hooks could be engaged e.g. a boat rail or building roof ledge.

According to the description hereinabove, I have invented a novel and improved sportsman's field ladder of the pole type for use in tree climbing and the like which provides for enhanced and simplified support of the ladder with respect to a tree to be climbed, enhanced economy and simplicity of construction, and enhanced portability through the simplified design and through reduced weight and the unique carrying arrangement which permits the sections of the knockdown ladder to be carried as a single compact package in stacked fashion by means of a single handle.

Of course it will be understood that I have contemplated various alternative and modified embodiments other than those above described, and such would certainly also occur to those versed in the art once apprised of my invention. Accordingly, it is my intent that the invention be construed broadly and limited only by the scope of the claims appended hereto.

The embodiments of the invention in which an exclusive property or privilege is claimed are defined as follows:

1. In a pole-type ladder of knockdown construction comprising upper and lower, central, longitudinally-extending sections connectable together in substantially end-to-end relationship, a plurality of steps rigidly secured to and extending substantially transversely from opposite sides of said upper and lower sections, a connecting means for releasably connecting said upper and lower sections in substantially end-to-end relationship and a mounting means on said upper section and for mounting said ladder to a lateral support, wherein the improvement in said mounting means comprises:

a hook means rigidly secured to or formed integral with said upper section, adapted to engage said lateral support, and defining an opening adapted to receive said lateral support when said hook means is engaged with said lateral support; and a gusset means for centering said lateral support with respect to said opening to limit movement of said ladder with respect to said lateral support, when said hook means is engaged with said lateral support, and for rigidifying said hook means to resist torsional forces exerted on said hook means when said hook means is engaged with said lateral support and downward and lateral forces are exerted on said steps.

2. A pole-type ladder according to claim 1, wherein said upper section comprises an upper end; and said hook means comprises said upper end, a transverse member rigidly secured to or formed integral with and positioned substantially perpendicular to said upper end and a downwardly-depending member rigidly secured to or formed integral with said transverse member and positioned substantially parallel to said upper end, with said opening being defined by said upper end and said transverse and downwardly-depending members; and said gusset means comprises at least two gussets, with one of said gussets rigidly secured to and between said upper end and said transverse member and the other of said gussets rigidly secured to and between said downwardly-depending member and said transverse member, with said gussets defining a V-shaped pocket within said opening and adapted to receive said lateral support when said hook means is engaged with said lateral support.

3. A pole-type ladder according to claim 2, wherein one of said gussets is secured to and between adjacent sides of said upper end and said transverse member on one side of said hook means and the other of said gussets is rigidly secured to and between adjacent sides of said downwardly-depending and transverse members on another side of said hook means.

4. A pole-type ladder according to claim 3, and further comprising a cleat means on said upper section and for mounting said lower section to said upper section in mutually parallel, stacked relationship when said upper and lower, sections are not connected together in substantially end-to-end relationship.

5. A pole-type ladder according to claim 4, wherein said cleat means comprises a pair of L-shaped brackets secured to said upper section in spaced-apart relationship and which cooperate with said upper section to receive and support said lower section.

6. A pole-type ladder according to claim 5, wherein said upper section further comprises a tubular bottom end and said lower section comprises a tubular top end; and said connecting means comprises a sleeve rigidly secured to or formed integral with and positioned in axial alignment with a central, longitudinal axis of one of said upper and lower sections and in which one of said lower and upper sections, respectively, are adapted to telescopically engage, a pair of aligned bores extending through opposing walls of said bottom end, a pair of aligned holes extending through opposing side walls of said top end and adapted to align with said aligned bores when said upper and lower sections are telescopically engaged, and a pin adapted to removably engage said aligned bores and holes when said upper and lower sections are telescopically engaged to releasably connect said upper and lower sections in substantially end-to-end relationship.

7. A pole-type ladder according to claim 6, and further comprising a handle secured to said upper section and for carrying said upper and lower sections when said lower section is mounted to said upper section by said cleat means.

8. In a pole-type ladder comprising a central, longitudinally-extending section having an upper end, a plurality of steps projecting substantially transversely from opposite sides of said central section and a mounting means on said upper end and for mounting said ladder to a lateral support, wherein the improvement in said mounting means comprises:

a hook means rigidly secured to or formed integral with said central section, adapted to engage said lateral support, and defining an opening adapted to receive said lateral support when said hook means is engaged with said lateral support; and a gusset means for centering said lateral support with respect to said opening to limit movement of said ladder with respect to said lateral support when said hook means is engaged with said lateral support and for rigidifying said hook means to resist torsional forces exerted on said hook means when said hook means is engaged with said lateral support and downward and lateral forces are exerted on said steps.

9. A pole-type ladder according to claim 8, wherein said hook means comprises the upper end of said upper section, a transverse member rigidly secured to or formed integral with and positioned substantially perpendicular to said upper end and a downwardly-depending member rigidly secured to or formed integral with said transverse member and positioned substantially parallel to said upper member, with said opening being defined by said upper end and said transverse and downwardly-depending members; and said gusset means comprises at least two gussets, with one of said gussets rigidly secured to and between said upper end and said transverse member and the other of said gussets rigidly secured to and between said downwardly-depending member and said transverse member, with said gussets defining a V-shaped pocket within said opening and adapted to receive said lateral support when said hook means is engaged with said lateral support.

10. A pole-type ladder according to claim 9, and further comprising a handle rigidly secured to said central member and for carrying said ladder.

* * * * *